US011486152B2

(12) United States Patent
Mertes

(10) Patent No.: US 11,486,152 B2
(45) Date of Patent: Nov. 1, 2022

(54) PRESSURE DEVICE FOR ADJOINING DOVETAILED FLOORING MATERIAL

(71) Applicant: AMERICAN MAMMOTH TOOL CO., Goodyear, AZ (US)

(72) Inventor: Corey L. Mertes, Goodyear, AZ (US)

(73) Assignee: American Mammoth Tool Co., Goodyear, AZ (US)

( * ) Notice: Subject to any disclaimer, the term of this patent is extended or adjusted under 35 U.S.C. 154(b) by 0 days.

(21) Appl. No.: 17/684,938

(22) Filed: Mar. 2, 2022

(65) Prior Publication Data

US 2022/0282499 A1 Sep. 8, 2022

Related U.S. Application Data

(60) Provisional application No. 63/156,859, filed on Mar. 4, 2021.

(51) Int. Cl.
*E04F 21/24* (2006.01)

(52) U.S. Cl.
CPC ..... *E04F 21/24* (2013.01)

(58) Field of Classification Search
CPC . E04F 21/24; E04F 21/22; E04F 21/00; E04F 21/20
USPC ..... 492/13, 19, 60
See application file for complete search history.

(56) References Cited

U.S. PATENT DOCUMENTS 205,172 A * 6/1878 Bottum ..... B21D 1/06 72/211
1,209,431 A * 12/1916 Haight ..... B24B 7/188 451/352
1,894,548 A * 1/1933 Whitney ..... E04F 21/00 404/131
2,382,986 A * 8/1945 Ganley ..... E01C 19/27 180/20
3,127,299 A * 3/1964 Hecht ..... B27D 5/00 156/579

(Continued)

FOREIGN PATENT DOCUMENTS

JP 11293907 A 10/1999
JP 2006283469 A 10/2006

OTHER PUBLICATIONS

"100 lb. Vinyl and Linoleum Floor Roller with Transport Wheels," homedepot.com. https://www.homedepot.com/p/Roberts-100-lb-Vinyl-and-Linoleum-Floor-Roller-with-Transport-Wheels-10-952/204139722 [date accessed: Dec. 21, 2020].

*Primary Examiner* — James M Ference
(74) *Attorney, Agent, or Firm* — Binita J. Singh; Bold IP, PLLC

(57) ABSTRACT

A device provides for an efficient, fast, and less labor-intensive way of laying dovetailed interlocking flooring material which have interlocking tabs to connect adjoining flooring material. The device comprises of a chassis offering structural support to which all other elements are connected to either directly or indirectly. The chassis has an upper portion which accepts additional weight and an undercarriage portion which is configured to connect to one or more front wheels and back wheels. The front wheels are configured to put pressure along each side of the interlocking tabs, while the one or more back wheels are configured to press on the interlocking tabs, and wherein the combined weight of the device interlocks the interlocking tabs in the flooring material.

24 Claims, 7 Drawing Sheets

(56) References Cited

U.S. PATENT DOCUMENTS 3,641,643 A * 2/1972 Niemi ..... B27D 3/00 156/579
3,737,243 A * 6/1973 Dresher ..... E01C 19/262 404/122
D235,374 S * 6/1975 Aiello ..... D15/20
4,192,626 A * 3/1980 Wyckoff ..... E01C 19/262 280/124.179
D258,591 S * 3/1981 Wyckoff ..... D15/20
4,314,395 A * 2/1982 Brock ..... E04F 21/22 D8/51
4,923,559 A * 5/1990 Kennedy ..... E01C 23/185 156/577
5,184,446 A * 2/1993 Gustavsen ..... E04F 21/22 52/746.1
5,242,362 A * 9/1993 Talamantez ..... B05C 17/0232 16/427
5,393,289 A * 2/1995 Green ..... E04D 15/04 492/19
5,437,593 A * 8/1995 Gustavsen ..... A47G 27/0487 492/19
5,800,668 A * 9/1998 Bumb ..... A47G 27/0487 156/577
5,933,900 A * 8/1999 Wang ..... A47L 13/29 15/52.1
6,875,162 B2 * 4/2005 Barksdale ..... E04D 15/04 492/19
6,941,632 B1 * 9/2005 Mead ..... B29C 70/342 29/81.03
7,188,724 B1 * 3/2007 Crain ..... B25H 3/006 206/349
7,571,806 B2 * 8/2009 Crain ..... B25H 3/006 206/349
7,614,536 B2 * 11/2009 Shtylman ..... B27F 7/02 227/111
7,934,886 B2 * 5/2011 Dufty ..... A01G 20/35 404/125
8,161,611 B2 * 4/2012 DiMambro ..... B25D 9/00 173/90
8,414,220 B1 * 4/2013 Koba ..... E01C 19/285 404/117
9,855,490 B2 * 1/2018 McGuffie ..... A01D 34/824
D862,186 S * 10/2019 Oates ..... D8/51
2015/0190705 A1 * 7/2015 McGuffie ..... E01C 23/22 222/185.1
2019/0106893 A1 * 4/2019 Anderson ..... E04G 23/006

* cited by examiner

PRESSURE DEVICE FOR ADJOINING DOVETAILED FLOORING MATERIAL

CROSS-REFERENCE TO RELATED APPLICATIONS

This application is a non-provisional application which claims priority to Provisional Patent Application No. 63/156,859 filed on Mar. 4, 2021, which is incorporated by reference in its entirety.

FIELD OF THE DISCLOSURE

The present invention relates to a device for installing flooring material, and more particularly to a device for selectively adjoining dovetailed flooring material.

BACKGROUND

Generally, most buildings, including commercial and residential, utilize some form of flooring material to enhance the look and in some cases the feel of the floor. The installation of flooring material can require a system and technique which may be dependent on the type of material being used and also whether there are any interlocking systems designed on to the flooring material.

One such style of flooring material includes surface tiles which have dovetailed interlocking tabs. The dovetailed interlocking tiles are generally provided with the idea of an instant self-laying floor surface which can be used in a wide variety of residential, commercial, or industrial application areas. These types of tiles can be placed on a floor or subfloor, slid relative to adjacent tiles to the desired position, and pressed together with the adjacent tile to interlock them together. Currently, a rubber mallet is used to connect the tiles by hammering each interlocking tab so that the tabs on one tile are recessed into the adjoining tile. In such a case, the most ideal way to hammer the tabs into place requires an installer to be on his hands and knees on the floor and systematically hammer the interlocking tabs into place. Ensuring that the tiles are adjoined fully by hammering the tabs into the recessed areas on the adjoining tile can be time consuming and also laborious.

Thus, there exists a need in the industry for an apparatus for improving the laying and adjoining of interlocking floors in a more time efficient and less labor-intensive manner.

SUMMARY

The invention described herein addresses and overcomes the above-described deficiency of laying dovetailed interlocking flooring material.

In one or more embodiments, a device is disclosed that provides for an efficient, fast, and less labor-intensive way of laying dovetailed interlocking flooring material. The device is a roller device comprised of a chassis which offers structural support to which all other elements are connected to either directly or indirectly. The chassis has an upper portion and an undercarriage portion wherein, the upper portion accepts additional weights to add more weight to the roller device, and the undercarriage is configured to connect to two or more wheels. In one or more non-limiting embodiments, a front undercarriage portion is connected to two wheels which are arranged on an axle with a spacer between the two wheels. A back of the undercarriage portion is connected to one wheel which has a ridge centrally configured and the wheel is as wide as a width of the undercarriage portion. The roller device has a combined weight that puts a significant amount of pressure on the interlocking tabs on the dovetailed interlocking flooring material so that the weight of the roller device efficiently and quickly adjoins the adjacent interlocking tabs.

Additionally, the roller device comprises a handle which is attached to a top of the chassis. The handle helps push the roller device over the interlocking flooring material. In the one or more embodiments, the handle is comprised of three parts which allows the handle to be removably connected to the chassis so that the handle may be removed for easy storage and transport. Additionally, the weights that can be added onto the chassis are also removable so that transporting the roller device is easy as the combined weight of the roller device would make it difficult to lift for transport and storage purposes if the parts were not removable.

Other aspects and advantages of the invention will be apparent from the following description and the appended claims.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION

Figure 1:
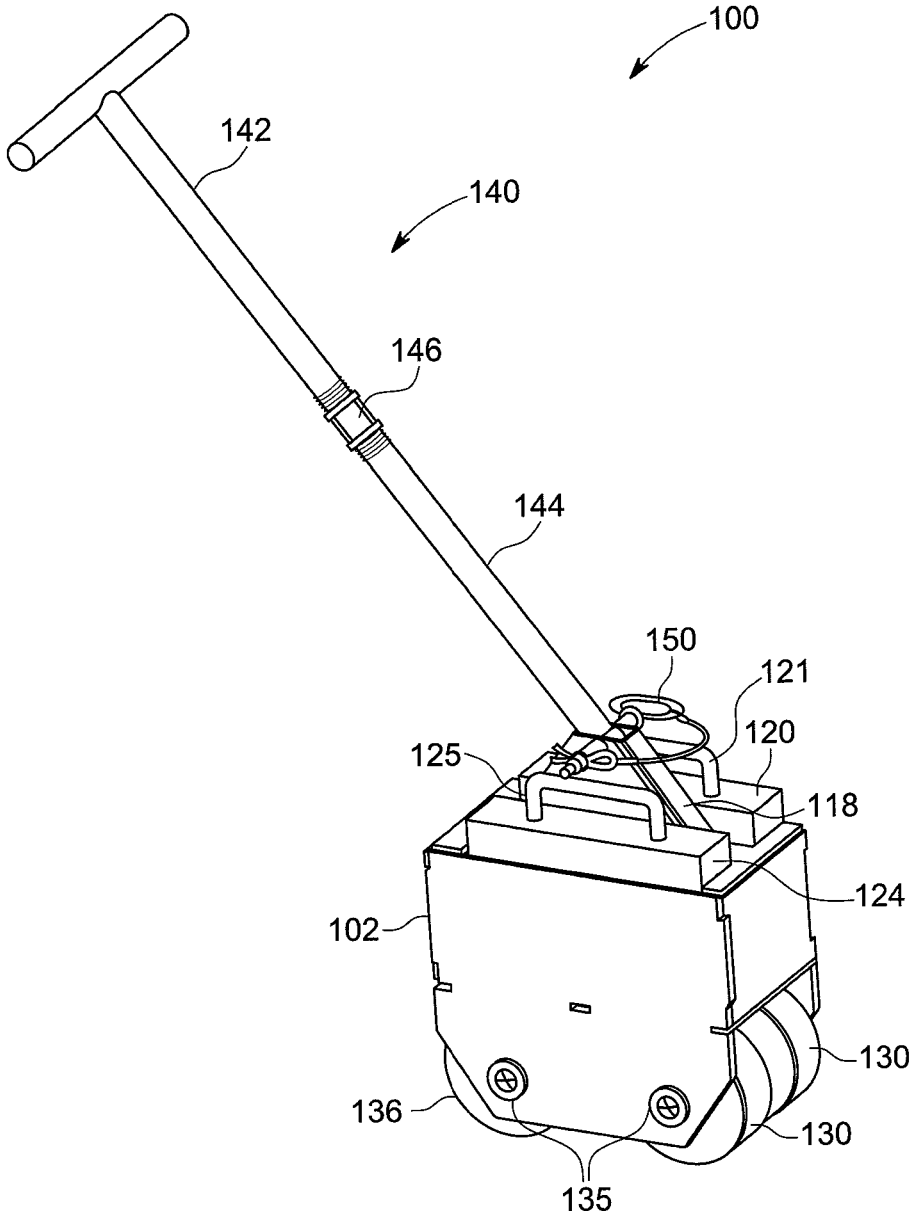
FIG. 1 is a perspective view of a weighted floor roller according to one or more non-limiting embodiments.

In the Summary above and in this Detailed Description, and the claims below, and in the accompanying drawings, reference may be made to particular features of the invention. It may be understood that the disclosure of the invention in this specification includes all possible combinations of such particular features. For example, where a particular feature may be disclosed in the context of a particular aspect or embodiment of the invention, or a particular claim, that feature can also be used, to the extent possible, in combination with and/or in the context of other particular aspects and embodiments of the invention, and in the invention generally.

Where reference may be made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" may be used herein to mean "serving as an example, instance, or illustration." Any aspect described in this document as "exemplary" may not necessarily be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items" may indicate the presence of only one item or may indicate more items. Thus, the term "set" may be equivalent to "one or more" as used herein.

The present disclosure is generally drawn to various embodiments for a device that provides for a more efficient way to install dovetailed interlocking flooring tiles. The present disclosure describes a weighted floor roller that reduces the time it takes for installing dovetailed interlocking flooring tiles. Additionally, the weighted floor roller also reduces the intensity required by a floor layer to efficiently interlock the dovetailed tiles. The weighted floor roller makes the process of installing dovetailed interlocking flooring tiles much more efficient by reducing the time and making it less labor intensive. The device comprises of two or more solid heavy metal rolling wheels that are aligned with the path of travel of the device that apply pressure to the flooring tiles during installation to connect the interlocking tabs on adjoining dovetailed flooring tiles. The metal wheels are arranged within a chassis. The housing may be configured to allow additional weight to be added to the device. The weighted floor roller may also comprise of a handle which aids in moving the weighted roller over the tiles to adjoin the interlocking elements on the flooring tiles.

Figure 2:
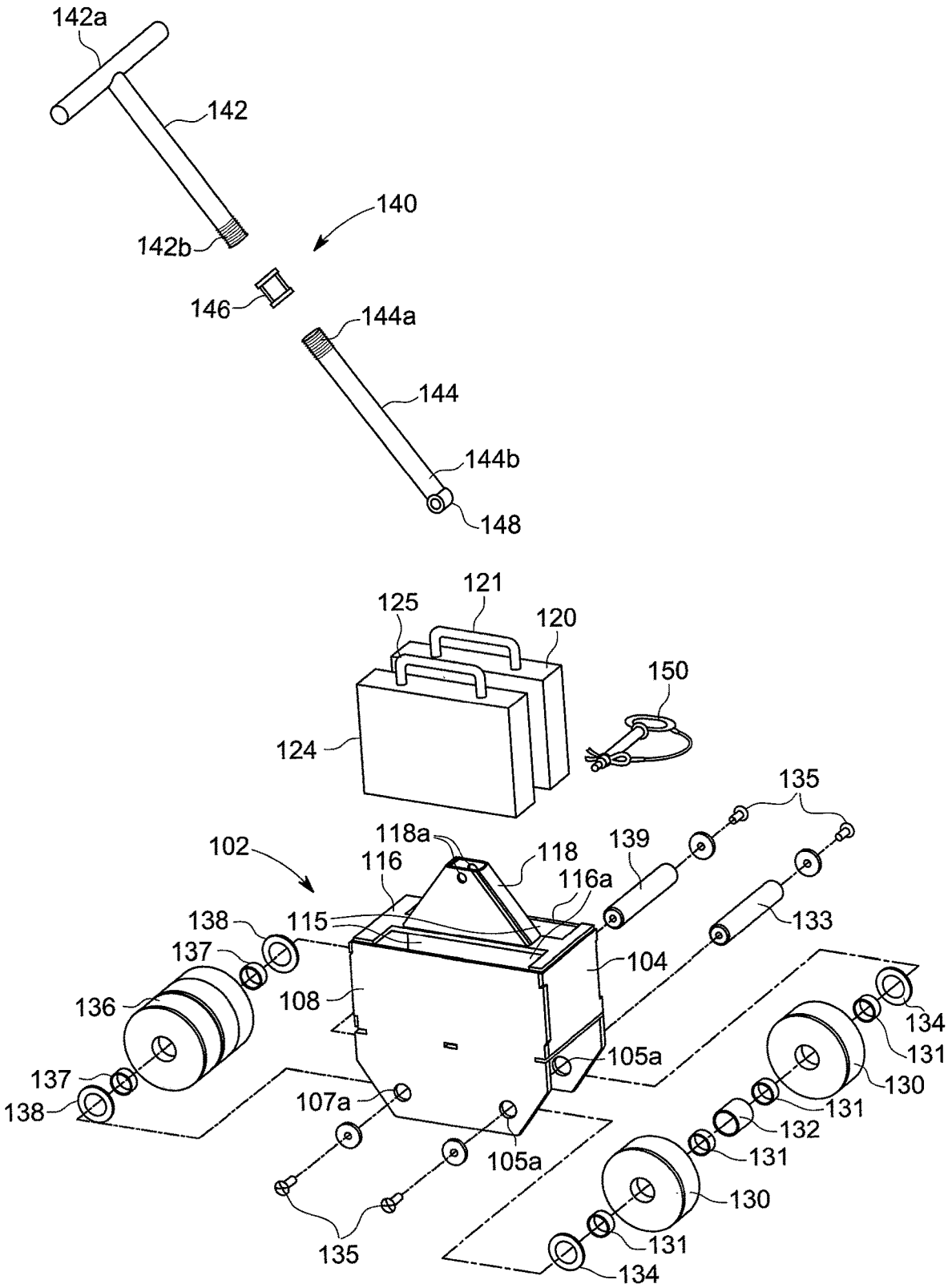
FIG. 2 is an exploded view of the weighted floor roller according to one or more non-limiting embodiments.

Referring to the figures, FIGS. 1 and 2 show a schematic of a weighted floor roller 100 constructed in accordance with a non-limiting preferred embodiment of the present invention. FIG. 1 illustrates a perspective view of the weighted floor roller 100. FIG. 2 illustrates an exploded view of the weighted floor roller 100. The weighted floor roller 100 is adapted for installing dovetailed interlocking flooring tiles, and specifically for the purpose of sealing the interlocking elements of adjoining tiles by applying pressure on them. In accordance with achieving this purpose, one such configuration and geometry is shown in the illustrated non-limiting embodiment of the weighted floor roller 100, and other configurations and geometries are also within the realm of this disclosure.

Referring to FIGS. 1 and 2, the floor roller 100 is generally shown to comprise of a chassis 102, one or more removable weights 120, 124, one or more front wheels 130, one or more back wheels 136, and a handle 140. The one or more front wheels and back wheels 130, 136 are connected to the chassis 102 and positioned to allow the floor roller 100 to roll on a surface. The chassis 102 is configured to accept the one or more removable weights 120, 124. Additionally, the handle 140 is connected to a top of the chassis 102 so that the floor roller 100 may be moved by using the handle 130.

Referring to FIGS. 2 and 3, the chassis 102 is the supporting framework of the floor roller 100 and structurally supports the other elements comprising the floor roller 100. The chassis 102 may be fabricated from any solid material that can provide ample support and weight to the overall structure and purpose of the floor roller 100. The preferred material may include metal such as and not limited to steel, iron, or a composite. The chassis 102 has a front panel 104, a back panel 106, and two side panels 108, 110. The two side panels 108, 110, are parallel to each other and the front panel 104 and the back panel 106 are parallel to each other. The two side panels 108, 110 are connected to the front panel 104 and the back panel 106 to form an enclosed structure with a top end and a bottom end of the chassis 102 open. For purposes of this disclosure, "front" and "back" as in the front panel 104 and the back panel 106 are defined by the direction the weighted floor roller 100 is intended to be moved to perform its function. The weighted floor roller 100 is generally advanced forward with the front panel 104 ahead of the back panel 106.

Figure 3A:
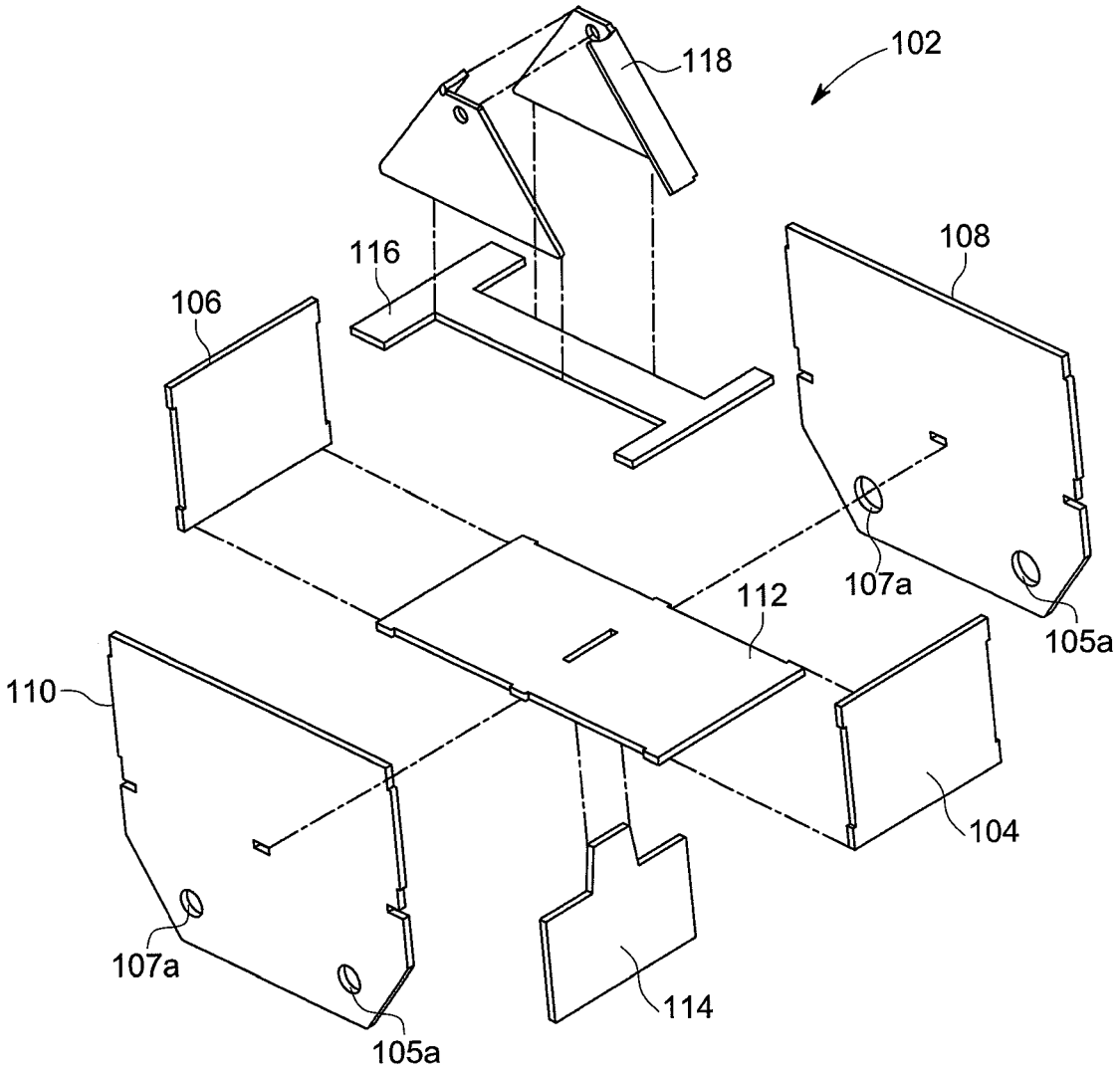
FIG. 3A is an exploded view of a chassis of the weighted floor roller according to one or more non-limiting embodiments.
Figure 3B:
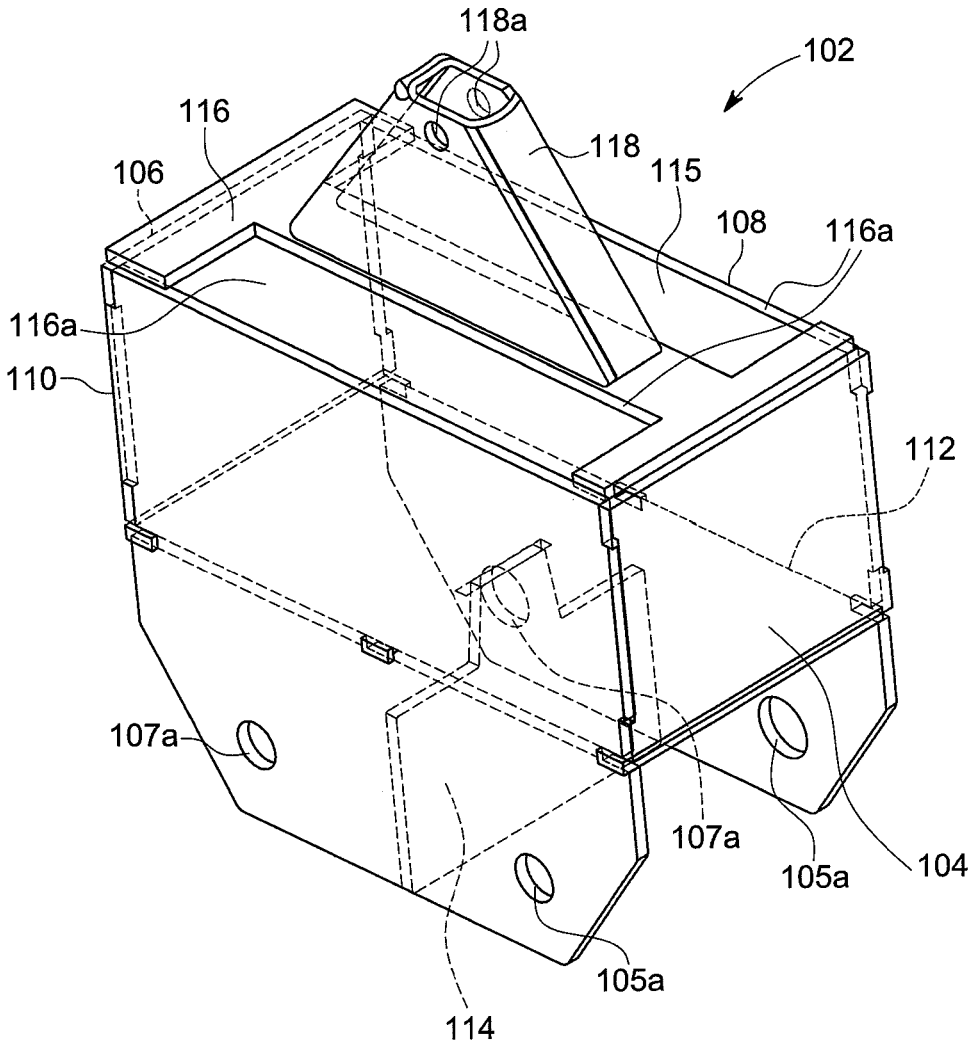
FIG. 3B is perspective view of the chassis from FIG. 3A.

The front, back, and side panels 104, 106, 108, 110, are also connected to a divider panel 112 which separates the chassis 102 into two sections, an undercarriage section, and an upper section. As seen in FIGS. 3A and 3B, the divider panel 112 is positioned within the enclosed structure and is relatively perpendicular to the front, back, and side panels 104, 106, 108, 110. The undercarriage section is on a bottom of the chassis 102, below the divider panel 112, and is configured to attach to the wheels 130, 136. The upper part of the chassis 102 is above the divider panel 112 and is defined by a hollow cavity 115. The upper part of the chassis 102 with the hollow cavity 115 is configured to receive the removable weights 120, 124.

FIGS. 3A and 3B shows the cavity 115 in the chassis 102. As mentioned above, the hollow cavity 115 configured within the chassis 102 accommodates the removable weights 120,124. The hollow cavity 115 within the chassis 102 receives the removable weights 120, 124 which sit at least part way within the chassis 102. A top plate 116 is connected to the top end of the chassis 102 and is configured to allow the removable plates 120, 124 to be placed through the top plate 116 and sit within the cavity 115 resting on top of the divider panel 112. The top panel 116 is relatively parallel to the divider panel 112 connected within the chassis 102. The hollow cavity 115 may be accessed through one or more openings 116*a* on the top panel 116 of the chassis 102. The one or more openings 116*a* are each configured with a size and shape to allow the removable weights 120, 124 to slip through and at the same time provide support to hold the removable weights 120, 124 in place. For example, the one or more openings 116*a* may have a rectangular shape to accommodate a shape of the removable weights 120, 124. As best seen in FIGS. 3A and 3B, the top panel 116 has an "I" shape with a top and bottom of the "I" connected to a top of the front panel 104 and a top of the back panel 106 and the one or more openings 116*a* abutting the side panels 108.

As seen in FIG. 2, the one or more removable weights 120, 124 also comprise part of the weighted floor roller 100 and in this embodiment, there are two removable weights 120, 124. The removable weights 120, 124 are provided as a means to augment the weighted floor roller 100 with additional weight which is necessary to effectively and properly seal the interlocking portions of adjoining flooring tiles. The removable weights 120, 124 may also be fashioned from metal such as and not limited to steel, iron, or a composite. The figures show the removable weights 120, 124 as having an overall rectangular shape, however, any shape and geometry may be considered for the removable weights 120, 124 as long as the purpose of providing additional weight is achieved. Referring to the embodiment in the figures, the removable weights 120, 124 are configured such that the weights can be easily placed within and removed from the hollow cavity 115 of the chassis 102. To aid in the placement and removal within the chassis 102, the removable weights 120, 124 may also be configured with a handle each, referred to as weight handle 121, 125, respectively. The weight handles 121, 125 may also be configured of the same material as the removable weights 120, 124 and are provided such as to make the placing and removing of the removable weights 120, 124 easier.

Alternate means of adding weights may also be contemplated within this disclosure. One such example (not shown in the figures) of adding additional weights may include the chassis 102 configured with a metal rod that may extend relatively perpendicularly upward from the chassis 102 onto which removable weights may be placed. In such an example, the removable weights may include an aperture allowing the removable weights to be securely placed over the metal rod. It is also to be understood that the weighted metal roller may, in alternate embodiments, be comprised of non-removable weights. However, the preferred embodiment of the weighted floor roller 100 as disclosed herein, is provided with removable weights 120, 124 to make transporting the weighted floor roller 100 and the removable weights 120, 124 easier.

Figure 4:
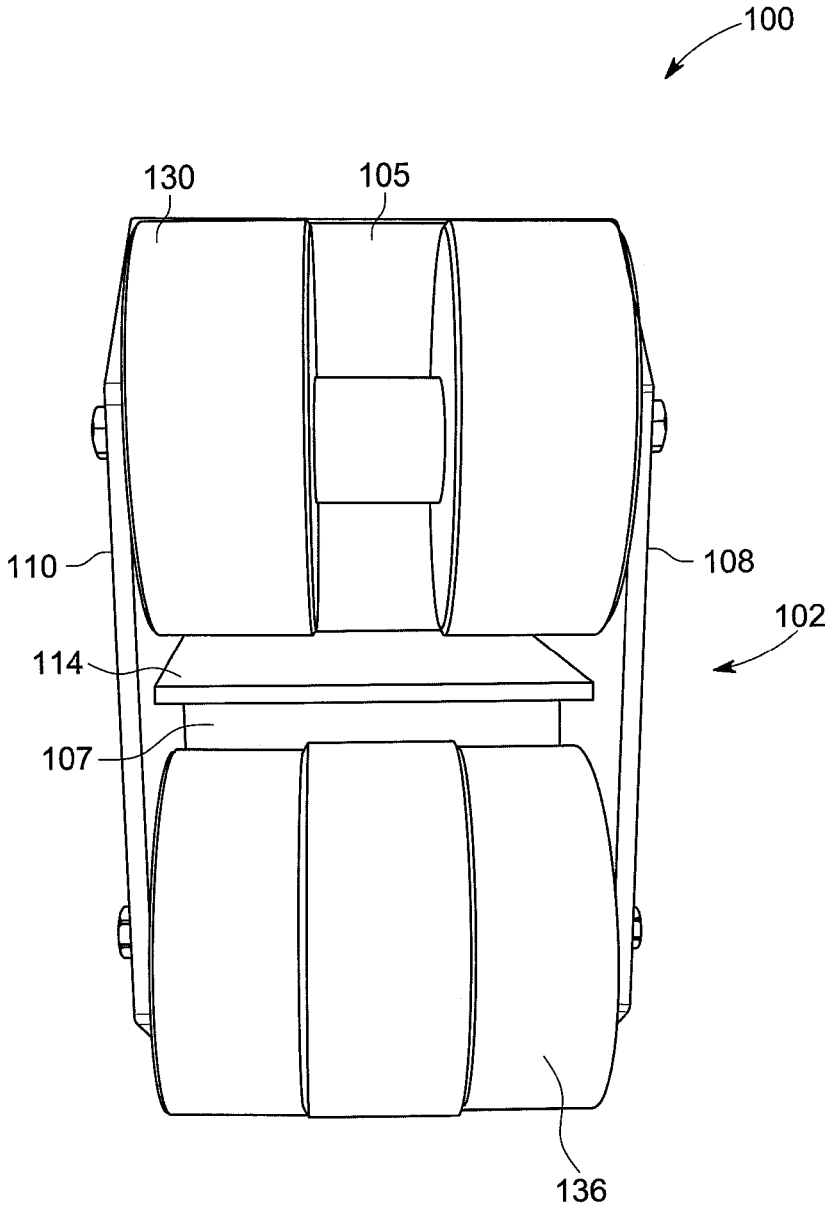
FIG. 4 is a bottom view of the weighted floor roller according to one or more non-limiting embodiments.

Referring to FIGS. 3A, 3B and 4, the chassis 102 also comprises of an undercarriage divider panel 114 which separates the undercarriage portion into a front undercarriage portion 105 and a back undercarriage portion 107. The undercarriage divider panel 114 is perpendicularly connected to the divider panel 112 on a side facing the undercarriage portion. The undercarriage divider panel 114 is connected relatively at a midpoint of the divider panel 112 and is also connected to the two sides 108, 110. The undercarriage divider panel 114 separates the undercarriage portion into a front undercarriage portion 105 and a back undercarriage portion 107 corresponding with the front panel 104 and the back panel 106 of the chassis 102, respectively. The wheels 130, 136 are positioned and connected to the chassis 102 in the front undercarriage portion 105 and the back undercarriage portion 107, respectively. The undercarriage divider panel 114 provides structural stability to the chassis 102.

The weighted floor roller 100 also comprises of one or more front wheels 130 and one or more back wheels 136. The one or more front wheels 130 and the one or more back wheels 136 are each configured as a solid piece and entirely of a heavy metal including and not limited to steel, iron, or a composite. Referring to the non-limiting embodiment shown in FIGS. 2, 4, 5A, and 5B, the weighted metal roller 100 is shown to comprise of two front wheels 130 and one back wheel 136 which are connected to the undercarriage portion of the chassis 102.

The front undercarriage portion 105 of the chassis 102 can include one or more front wheels 130. As shown in the figures, the front undercarriage portion 105 includes two front wheels 130 configured side by side and connected to the chassis 102. FIG. 2 illustrates the arrangement of the two front wheels 130 as it is connected to the chassis 102. The two front wheels 130 are placed on a front axle 133 with the front wheels 130 on each end of the front axle 133. In such a configuration, the front wheels 130 are spaced apart from each other with a spacer 132 between them and giving the arrangement of the two wheels 130 on the front axle 133 a dumbbell appearance. Each of the two front wheels 130 also include bearings 131 which allows the front wheels 130 to roll smoothly and avoids wear and tear on the front wheels 130 and the front axle 133 as would be possible without the bearings 131. The front wheels 130, front axle 133, and the bearings 131 are fashioned from a heavy metal such as and not limited to steel and iron.

The front axle 133 connects the front wheels 130 to the chassis 102. In particular, the two sides 108, 110 of the chassis 102 in the front undercarriage portion 105 are each configured with an opening 105*a*. The front axle 133 with the two wheels 130 is arranged between the openings 105*a* and connected to the two side walls 108, 110 with a washer and screw combination 135. Additionally, a washer 134 is also used on the front axle 133 in the front undercarriage portion 105 against the two sides 108, 110.

It is to be understood that the front wheels 130 and the front axle 133 may be fashioned all from a single piece of a heavy metal. Additionally, it is also to be understood, that the front undercarriage portion 105 may include a single front wheel which may be as wide as a space between the two sides 108, 110 or may be smaller in width and centered within the front undercarriage portion 105.

Figure 5A:
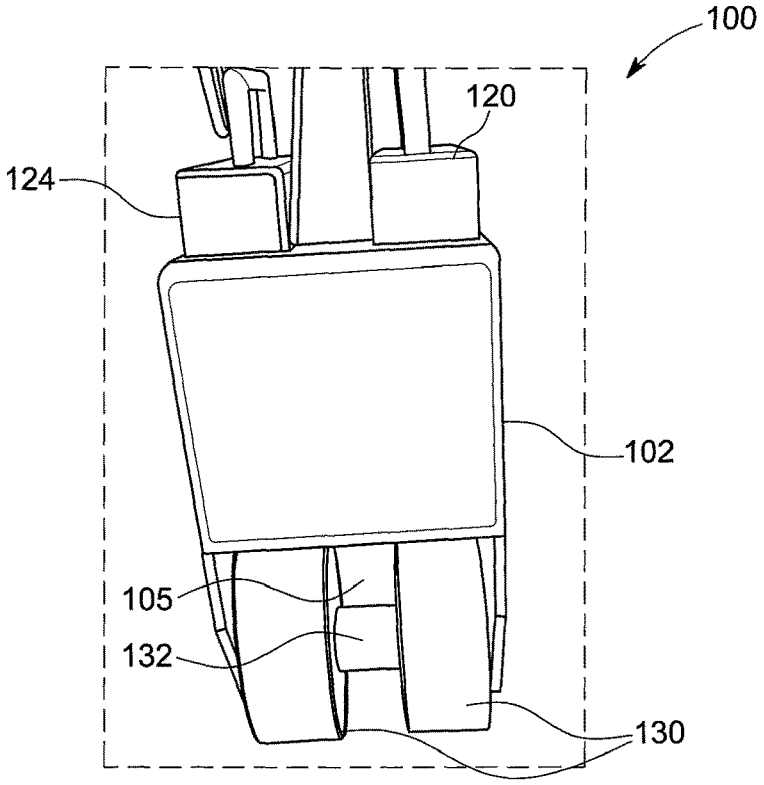
FIG. 5A is a front view of the weighted floor roller illustrating a dual wheel set up according to one or more non-limiting embodiments.
Figure 5B:
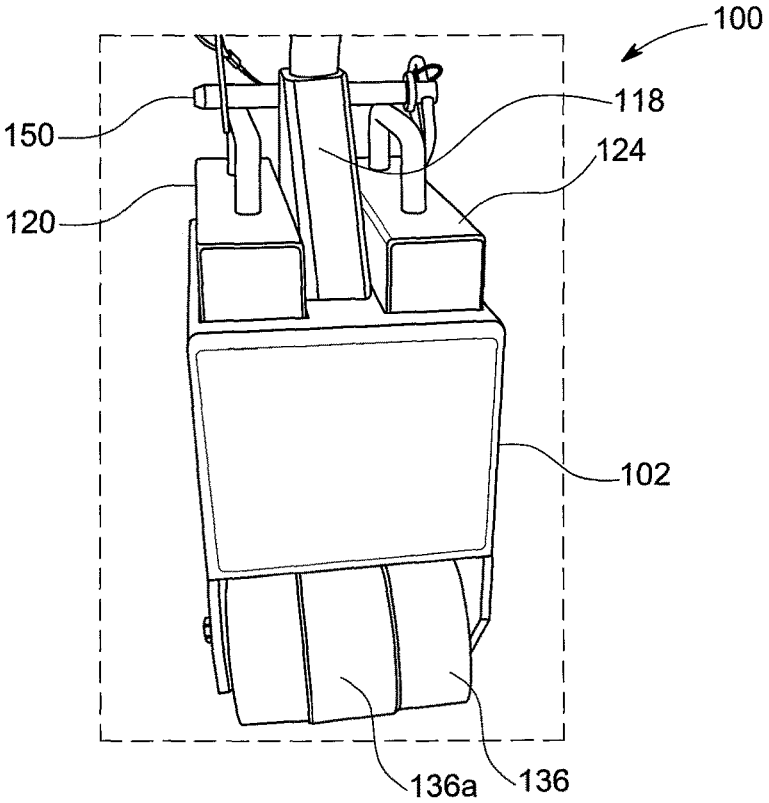
FIG. 5B is a back view of the weighted floor roller illustrating a single wheel according to one or more non-limiting embodiments.

The back undercarriage portion 107 of the weighted floor roller 100 is integrated with the one or more back wheels and shown as comprising of one back wheel in FIGS. 2, 4, and 5A. The back wheel 136 is in-line and behind the two front wheels 130. In the non-limiting embodiment shown, the back wheel 136 has a width that has a width relatively similar to a width of the chassis defined by a space between the two parallel sides 108, 110. The back wheel 136 is also arranged on an axle, a back axle 139, wherein the back wheel 136 also includes one or more bearings 137 to allow for smooth rolling of the back wheel 136. The back wheel 136 and the back axle 139 may also be fashioned from a heavy metal such as and not limited to steel and iron. The back axle 139 connects the back wheel 136 to the back undercarriage portion 107 of the chassis 102. The two sides 108, 110 of the chassis 102 in the back undercarriage portion 107 are each configured with an opening 107*a*. The back axle 139 with the back wheel 136 is arranged between the openings 107*a* and connected to the two side walls 108, 110 with a washer and screw combination 135. Additionally, a washer 138 is also used on the back axle 139 in the back undercarriage portion 107 against the two sides 108, 110.

The back wheel 136 is further configured with a ridge 136*a* on its outer circumference which is relatively configured at a center point of a width of the back wheel 136. The ridge 136*a* is configured to have a width relatively equal to a width of the spacer 132 between the front wheels 130 and is also in line with the spacer 132. It is also to be understood that the ridge 136*a* may be wider or smaller than the width of the spacer 132. The ridge 136*a* may have a width anywhere between a range of 0.5 inches to 3 inches. The ridge 136*a* is configured on the back wheel 136 to provide pressure along the interlocking portions of adjoining dovetailed interlocking tiles. As the weighted roller device 100 is moved over adjoining interlocking portions of a pair of tiles, the two front wheels 130 are aligned over the interlocking tiles with the spacer 132 relatively positioned over the interlocking portions. As the weighted roller device 100 is moved, the front wheels 130 put pressure immediately along each side of the interlocking portions of the tiles which aligns and pushes the interlocking portions together, while the back wheel 136 completes a process of adjoining the tiles by pressing onto the interlocking portions with the ridge 136*a*. A weight of the roller device 100 ensures that the interlocking portions on the adjoining tiles are securely interlocked.

In alternate embodiments, the back roller 136 may have a width relatively equal to the width of the spacer 132 between the two front wheels 130. It is also to be understood that the back roller 136 may be configured as one solid piece without a ridge 136*a*. However, the preferred embodiment as disclosed herein and shown in the figures is comprised of the back roller 136 with the ridge 136*a*.

The weighted floor roller 100 may also comprises of a handle 140 that is provided for a user to move the weighted floor roller 100 over the dovetailed interlocking tiles. As shown in FIGS. 1 and 2, the handle 140 is comprised of an upper piece 142, a lower piece 144, and a coupler 146. The coupler 146 removably couples the upper and lower pieces 142, 144 together. FIG. 1 illustrates the handle 140 coupled together. Referring to FIG. 2, the upper piece 142 has a top end 142*a* and a bottom end 142*b*. The top end 142*a* includes a holding portion, which is what a user holds on to in order to push the roller device 100. The bottom end 142*b* includes threads that matingly connect with threads on the coupler 146. The lower piece 144 also has a top end 144*a* and a bottom end 144*b*, and the top end 144*a* includes threads that matingly connect with threads on the coupler 146. The bottom end 144*b* of the lower piece 144 includes a tubular element 148 that connects with a handle mount on the chassis 102 (discussed below). Having the handle 140 comprise of several pieces allows the handle to be dismantled during storage and transporting to locations where the roller device 100 will be used.

Figure 6:
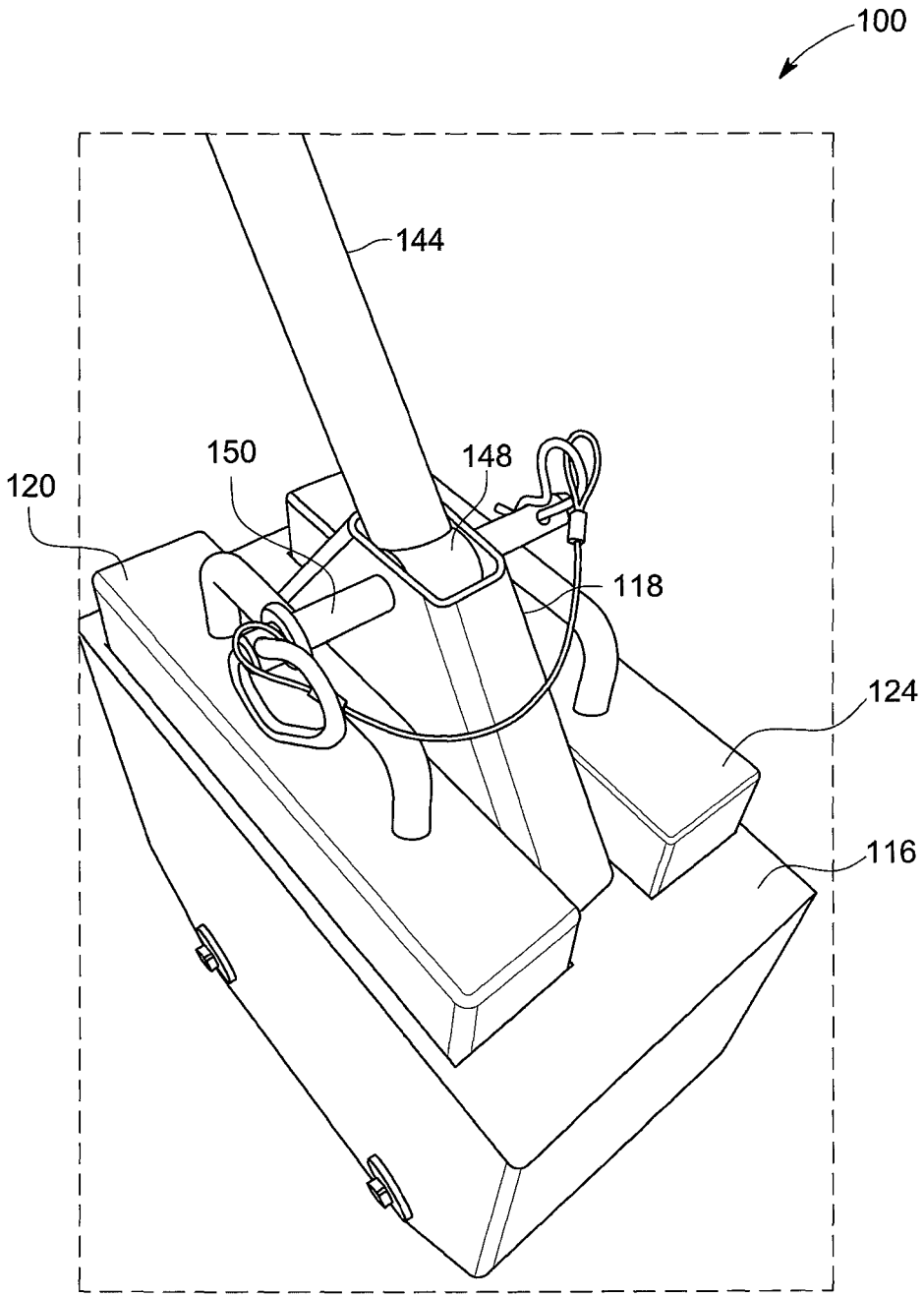
FIG. 6 is a top perspective view of the weighted floor roller according to one or more non-limiting embodiments.

In FIGS. 1, 2, and 6, the handle 140 is connected to the handle mount 118 on the chassis 102. Specifically, the handle mount 118 is connected to the top panel 116 of the chassis 102. The handle mount 118 may be configured as a part of the top panel 116 or alternatively, the handle mount 118 may be attached to the top panel 116 by any means known in the art, including and not limited to welding. The handle mount 118 is configured to connect with the tubular element 148 of the handle 140. The handle mount 118 may have a hollow structure with an opening 118*a* that traverses through sides of the handle mount 118. The openings 118*a* on the handle mount and the tubular element 148 on the handle 140 are aligned and a hitch pin 150 is placed thorough the openings 118*a* and the tubular element 148 to connect and hold the handle 140 to the chassis 102. The hitch pin 150 includes a tethered hairpin to lock the hitch pin 150 in place and prevent the hitch pin 150 from coming out of the opening 118*a* and the tubular element 148. The hitch pin 150 also allows the handle 140 to pivot forward and backward at the connection of the tubular element 148, the openings 118*a* in the handle mount 118, and the hitch pin 150. It is also to be understood that the tubular element 148 on the handle 140 may be joined to the handle mount 118 by other fasteners known in the arts. It is to be understood that other types of handles are also contemplated to be a part of this disclosure as long as they serve the purpose of moving the weighted floor roller 100 over the interlocking tiles. Additionally, it is also to be understood that other means of attaching the handle 140 to the chassis are also contemplated to be a part of this disclosure.

In other non-limiting embodiments, the weighted floor roller 100 may also be incorporated with lights, such as LED lights, on a front panel 104 and a back panel 108. The lights are positioned to be lighting up the portion immediately in front of and behind the weighted roller device 100 so that the light shines on the interlocking portions of the tiles to make them more visible to verify that the interlocking portions are adjoined correctly and fully. It is also to be understood, that in other alternate embodiments, the weighted floor roller 100 may be incorporated or integrated with a motorized means whereby the weighted metal roller may be moved a lot easier. Additional non-limiting embodiments may also incorporate or integrate a battery powered means whereby a motorized means may be powered to move the weighted metal roller. It is also to be understood, that alternatively, the non-limiting motorized means utilized to move the weighted floor roller may also be integrated with a means to power the motor with electrical power, such as including a power cord that can be connected to an electrical power supply.

The corresponding structures, materials, acts, and equivalents of any means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention, according to one or more embodiments described in the present description, may be practiced with modification and alteration within the spirit and scope of the appended claims. Thus, the description is to be regarded as illustrative instead of restrictive of the present invention.

What is claimed is:

1. A device, comprising:

a chassis having a front panel, a back panel, and two parallel sides that are connected to the front panel and the back panel forming an enclosed structure with an open top end and an open bottom end;

at least one weight configured to be placed within the chassis;

one or more front wheels connected to the chassis;

one or more back wheels connected to the chassis in line with the one or more front wheels, wherein an outer circumference of each of the one or more back wheels is configured with a raised ridge, wherein the raised ridge is relatively at a center point of a width of each of the one or more wheels; and wherein the one or more front wheels, the one or more back wheels, and a combined weight of the device are adapted to press interlocking tabs on a flooring material while the device is rolled over the flooring material.

2. The device of claim 1, wherein a divider panel is perpendicularly connected to the front panel, the back panel, and the two parallel sides within the enclosed structure, wherein the divider panel separates the chassis into an upper portion which is above the divider panel, and an undercarriage portion which is below the divider panel.

3. The device of claim 2, wherein the at least one weight is placed in a hollow cavity formed within the upper portion of the chassis wherein the at least one weight rests on top of the divider panel, and wherein the at least one weight is removable from within the upper portion of the chassis.

4. The device of claim 2, wherein the one or more front wheels and one or more back wheels are connected to the chassis in the undercarriage portion, wherein the one or more front wheels and one or more back wheels are each configured as a solid piece and are fashioned from a heavy metal chosen from a steel, an iron, or a composite.

5. The device of claim 4, wherein an undercarriage divider panel is connected to the divider panel on a side facing the undercarriage portion, wherein the undercarriage divider panel is perpendicular to the divider panel and is positioned between the one or more front wheels and the one or more back wheels.

6. The device of claim 1, wherein a top panel having one or more openings is connected to the front panel and the back panel on the open top end of the chassis, wherein the one or more openings are configured to allow the one or more weights to be placed through the one or more openings and into the chassis.

7. The device of claim 1, wherein the one or more front wheels comprises two wheels wherein the two wheels are arranged on an axle with a spacer separating the two wheels wherein the axle with the two wheels is connected to the two parallel sides of the chassis.

8. The device of claim 7, wherein the raised ridge is in line with the spacer separating the two wheels comprising the one or more front wheels and the raised ridge has a width equal to a width of the spacer.

9. The device of claim 1, wherein the one or more back wheels comprises one wheel wherein the one wheel has a width relatively similar to a width of the chassis defined by a space between the two parallel sides, wherein the one wheel is arranged on an axle which is connected to the two parallel sides of the chassis.

10. The device of claim 1, wherein the raised ridge has a width between 0.5 inches to 3 inches.

11. The device of claim 1, wherein a handle is connected to the chassis.

12. The device of claim 11, wherein the handle is connected to a handle mount on a top panel of the chassis, wherein the handle has a tubular element that aligns with one or more openings on the handle mount when the tubular element of the handle is placed within a hollow structure formed by the handle mount, and wherein a locking pin is inserted through the one or more openings in the handle mount and the tubular element to connect the handle to the handle mount, and wherein the handle is removable from the handle mount.

13. The device of claim 1, wherein the chassis is fashioned from a heavy metal chosen from a steel, an iron, or a composite.

14. A device, comprising:

a chassis having a front panel, a back panel, and two parallel sides that are connected to the front panel and the back panel forming an enclosed structure with an open top end and an open bottom end, wherein a divider panel is connected to the front panel, the back panel, and the two parallel sides within the enclosed structure forming an upper portion above the divider panel and an undercarriage portion below the divider panel;

at least one weight configured to be placed within the upper portion of the chassis, wherein the at least one weight rests on top of the divider panel;

one or more front wheels and one or more back wheels connected to the chassis in the undercarriage portion, wherein the one or more back wheels are in line with the front wheel and an outer circumference of each of the one or more back wheels comprise of a raised ridge;

wherein the one or more front wheels, the one or more back wheels, and a combined weight of the device are adapted to press interlocking tabs on a flooring material while the device is rolled over the flooring material.

15. The device of claim 14, wherein an undercarriage divider panel is connected to the divider panel on a side facing the undercarriage portion, wherein the undercarriage divider panel is perpendicular to the divider panel and is positioned between the one or more front wheels and the one or more back wheels.

16. The device of claim 14, wherein a top panel having one or more openings is connected to the front panel and the back panel on the open top end of the chassis, wherein the one or more openings are configured to allow the one or more weights to be placed through the one or more openings and into the chassis.

17. The device of claim 14, wherein the one or more front wheels comprises two wheels wherein the two wheels are arranged on an axle with a spacer separating the two wheels wherein the axle with the two wheels is connected to the two parallel sides of the chassis.

18. The device of claim 14, wherein the one or more back wheels comprises one wheel wherein the one wheel has a width relatively similar to a width of the chassis defined by a space between the two parallel sides, wherein the one wheel is arranged on an axle which is connected to the two parallel sides of the chassis, and wherein the raised ridge is relatively at a center point of a width of the one wheel.

19. The device of claim 18, wherein the raised ridge is in line with the spacer separating the two wheels comprising the one or more front wheels and the raised ridge has a width equal to a width of the spacer.

20. The device of claim 19, wherein the raised ridge has a width between 0.5 inches to 3 inches.

21. The device of claim 14, wherein the chassis, the one or more front wheels, and the one or more back wheels are fashioned from a heavy metal chosen from a steel, an iron, or a composite, wherein the one or more front wheels and the one or more back wheels are each configured as a solid piece.

22. The device of claim 14, wherein a handle is connected to the chassis.

23. The device of claim 22, wherein the handle is connected to a handle mount on a top panel of the chassis, wherein the handle has a tubular element that aligns with one or more openings on the handle mount when the tubular element of the handle is placed within a hollow structure formed by the handle mount, and wherein a locking pin is inserted through the one or more openings in the handle mount and the tubular element to connect the handle to the handle mount, and wherein the handle is removable from the handle mount.

24. A device, comprising:

a chassis having an enclosed structure with an open top end and an open bottom end, wherein a divider panel within the chassis separates the chassis into an upper portion and an undercarriage portion;

at least one weight configured to be placed into the upper portion through the open top end;

one or more front wheels connected to the chassis in the undercarriage portion;

at least one back wheel having a raised ridge centrally configured on an outer circumference of the at least one back wheel, wherein the one back wheel is connected to the chassis in the undercarriage portion;

a handle connected to the chassis; and wherein the device is configured to press interlocking tabs on a flooring material while the device is rolled over the flooring material, wherein the one or more front wheels are configured to put pressure along each side of the interlocking tabs, wherein the raised ridge on the at least one back wheel is configured to press on the interlocking tabs, and wherein a combined weight of the device interlocks the interlocking tabs in the flooring material.

* * * * *